US008151829B2

(12) United States Patent
Makino

(10) Patent No.: US 8,151,829 B2
(45) Date of Patent: Apr. 10, 2012

(54) TRANSFERRING METHOD OF POWDER TONER FOR ELECTROPHOTOGRAPH AND TRANSFERRING APPARATUS THEREOF, AND FILLING METHOD OF POWDER TONER AND THE FILLING APPARATUS THEREOF

(75) Inventor: Kunio Makino, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 1301 days.

(21) Appl. No.: 11/814,080

(22) PCT Filed: Jan. 16, 2006

(86) PCT No.: PCT/JP2006/300896

§ 371 (c)(1),
(2), (4) Date: Jul. 17, 2007

(87) PCT Pub. No.: WO2006/075798

PCT Pub. Date: Jul. 20, 2006

(65) Prior Publication Data

US 2009/0010685 A1 Jan. 8, 2009

(30) Foreign Application Priority Data

Jan. 17, 2005 (JP) ..... 2005-008533
Jun. 14, 2005 (JP) ..... 2005-173154
Jan. 10, 2006 (JP) ..... 2006-002053

(51) Int. Cl.
*B65B 31/04* (2006.01)

(52) U.S. Cl. ..... 141/65; 141/12; 141/83; 141/71; 141/291; 141/374; 222/195

(58) Field of Classification Search ..... 141/12, 141/65, 83, 59, 70, 71, 198, 263, 279, 285, 141/286, 374; 53/432, 510; 399/25, 27, 399/258; 222/195
See application file for complete search history.

(56) References Cited

U.S. PATENT DOCUMENTS

| | | | | | |
|---|---|---|---|---|---|
| 4,185,669 | A * | 1/1980 | Jevakohoff | 141/59 |
| 4,976,296 | A * | 12/1990 | Pope | 141/46 |
| 5,423,356 | A * | 6/1995 | Reckersdrees | 141/67 |
| 5,704,403 | A * | 1/1998 | Schwenk et al. | 141/18 |
| 5,855,232 | A * | 1/1999 | Oda et al. | 141/83 |
| 6,679,301 | B2 * | 1/2004 | Makino et al. | 141/67 |
| 6,859,634 | B2 * | 2/2005 | Itoh et al. | 399/258 |
| 7,163,359 | B2 * | 1/2007 | Moser | 406/74 |
| 2002/0144746 | A1 | 10/2002 | Makino et al. | |
| 2006/0054085 | A1 * | 3/2006 | Sanner | 118/612 |

FOREIGN PATENT DOCUMENTS

| | | | |
|---|---|---|---|
| JP | 4 226672 | | 8/1992 |
| JP | 2000-206772 | * | 7/2000 |
| JP | 2001-234866 | | 8/2001 |
| JP | 2002 14509 | | 1/2002 |

(Continued)

*Primary Examiner* — Gregory Huson
*Assistant Examiner* — Jason Niesz
(74) *Attorney, Agent, or Firm* — Oblon, Spivak, McClelland, Maier & Neustadt, L.L.P.

(57) ABSTRACT

A powder toner transferring method that fluidizes a powder toner with a gas supplied from an air supply, sucks the fluidized powder toner with a suction, and transfers the powder toner by discharging the powder toner in a toner storage container. The suction of the powder toner is performed with a reciprocating-motion pump. A powder toner filling method includes the powder toner transferring process.

33 Claims, 6 Drawing Sheets

FOREIGN PATENT DOCUMENTS

| | | |
|---|---|---|
| JP | 2002-68125 | 3/2002 |
| JP | 2002 249101 | 9/2002 |
| JP | 2002 302169 | 10/2002 |
| JP | 2002 337801 | 11/2002 |
| JP | 2002-349454 | 12/2002 |
| JP | 3549053 | 4/2004 |
| JP | 2005 41501 | 2/2005 |
| JP | 2005 67651 | 3/2005 |
| JP | 2005 67652 | 3/2005 |
| JP | 2005 75372 | 3/2005 |

* cited by examiner

TRANSFERRING METHOD OF POWDER TONER FOR ELECTROPHOTOGRAPH AND TRANSFERRING APPARATUS THEREOF, AND FILLING METHOD OF POWDER TONER AND THE FILLING APPARATUS THEREOF

TECHNICAL FIELD

The present invention relates to a transferring method of a powder toner for electrophotograph and a transferring apparatus thereof, wherein the powder toner is fluidized by a gas for transfer, and a powder toner filling method and a filling apparatus thereof.

BACKGROUND ART

An auger filling apparatus which uses mechanical revolution has been conventionally employed for filling a powder toner for electrophotograph.

An external additive is usually adhered to the surface of the toner used for electrophotograph for higher fluidity. There have been many occasions where the external additive adhered to the toner surface falls off with the conventional auger apparatus to cause a quality problem. This issue has become more serious since a toner with smaller particle diameter has been used recently compared to conventional equivalents in order to obtain a high-quality image.

Regarding a toner material, an external additive and an antistatic additive comprising silica and titanium are adhered on the surface of the toner particle to maintain the fluidity and the electrostatic property of the toner. Application of strong stress on the toner exfoliates the additives, which causes negative effects on the electrostatic property during an image forming process.

For example, Japanese Patent Application Laid-Open (JP-A) No. 2002-249101 discloses an auger-type powder filling apparatus, which is suitable for mass production with a few items. As mentioned above, this powder filling apparatus has a problem that the apparatus stresses the toner and that the external additive falls off from the surface of the toner particles. Moreover, the apparatus is of large size, requiring a spacious installation site and industrial 200 V power supply.

Japanese Patent (JP-B) No. 3549053 proposes a powder filling apparatus, which fluidizes a powder by injecting a gas. In this proposal, a powder is transferred to a powder container and filled while the tip of a transfer nozzle for transferring and discharging a powder fluidized by a gas in the powder repository is surrounded by the powder residing in the powder repository. This filling apparatus applies less stress to the toner compared to the auger-type apparatus. However, the container must be pressurized due to the characteristics of the apparatus and sealed since the force does not transmit unless the pressure inside the toner repository is 6 kPa or greater, which results in a time lag of about five seconds. In addition, there is a problem that additional charges of the toner cannot be made since the repository is sealed. Moreover, there is a problem that the powder dust of toner easily disperses.

JP-A No. H04-226672 (Japanese Patent Application Publication (JP-B) No. H06-14960) describes a transfer by means of a bellows pump, i.e. an accordion pump. It is possible to transfer a liquid by means of the transfer method of this patent literature. However, a powder toner gets plugged in the bellows in transferring the powder toner; therefore, it cannot be transferred. Although weirs and chokes in bellows or flow paths do not usually affect the transfer of a liquid, there is a problem that the transfer of a powder toner is difficult since the powder toner accumulates at weirs and chokes in bellows or flow paths.

JP-A No. 2005-67651 proposes a transferring method by fluidizing a powder toner by supplying a gas. However, the powder transfer of the present proposal is not efficient, and sufficient accuracy in the transferred quantity cannot be achieved.

In JP-A No. 2002-302169, a toner is transferred by a so-called mono pump, but this does not resolve the problem of the external stress on the toner.

Regarding the filling efficiency, there are contradicting issues that higher filling accuracy requires longer filling time and that the shorter filling time decreases the filling accuracy. In particular, when the filled quantity is less than the displayed sales quantity, low filling accuracy causes not only a drawback for a customer but also a possible trust problem of the company who has sold goods with less than labeled quantity. On the other hand, a toner with more than a specified quantity is beneficial to a customer, but the accumulated excess may put pressure on the profit of the company.

Therefore, high filling accuracy as well as short filling time as filling efficiency is always required. As a specific solution to resolve this problem, JP-A No. 2005-67652 proposes a method to complete promptly the filling by degassing, i.e. removing air from the filled toner. However, this proposal has a problem that the weight cannot be accurately measured because the toner is sucked around the degassing mechanism when the filling and degassing are performed simultaneously.

Also, JP-A No. 2005-75372 proposes a method of filling a toner in a container with a limited volume in a short period of time with high density. Herein, the toner container is topped with a hopper, and the toner container and the hopper are connected. The predetermined amount of the toner is overflowed in the connected container, and the hopper is detached when the filling is completed. However, with the method of this proposal, it takes long to stabilize the scale on which the toner is weighed since the hopper is bulky and tall. Moreover, there is a problem that the toner adhered to the inside of the hopper flows out when the hopper is detached upon the completion of filling, which smudges around the toner container and the peripheral equipments.

Also, a method to increase the toner filling accuracy and further to reduce the filling time is proposed, wherein the lower end of a toner discharge pipe is made porous with a triple tube described in, for example, JP-A No 2005-41501; the discharge pipe is degassed through the backside of the porous portion; a toner is sucked to the surface of the porous portion to form 'plugs' to swiftly suspend the falling toner. However, this proposed method requires the formation of strong 'plugs' since the transfer needs to be stopped quickly without sacrificing the transferring amount of toner within the toner discharge pipe. Also, in the case of an automatic filling machine that performs a continuous filling operation, these 'plugs' must be removed before the start of the filling in the next toner container. Therefore, an air pulse of about 0.3 MPa is supplied from the backside of the porous portion for cleaning. Because of this, the 'plugs' do not get blown into the toner container or the hopper, but there is a problem that a part of the toner blown off gets out of the container to become the source of powder dust.

DISCLOSURE OF INVENTION

The present invention aims at providing: a transferring method of a powder toner for electrophotograph and a transferring apparatus of the powder toner, wherein the transferring method and the transferring apparatus are capable of transferring the powder toner without stressing as well as transferring without pressurizing or with minimum pressurization, does not cause plugging, are a portable transfer means to enable an on-demand use, and exhibits high performance; and a filling method of the powder toner and a filling apparatus which use thereof.

The present invention also aims at providing a filling method of a powder toner and a filling apparatus of the powder toner, wherein the filling method and the filling apparatus are capable of filling the powder toner in a flexible container in a high density.

The aspects of resolving the above issues are as follows:

In a first aspect, a toner transferring method fluidizes a powder toner in a powder toner repository with a gas supplied from an air supply unit, sucks the fluidized toner with a suction unit and transfers the powder toner by discharging the toner in a powder toner filling container, wherein the suction of the powder toner by the above-mentioned suction unit is performed with a reciprocating-motion pump.

The powder toner transferring method according to the first aspect, wherein the gas supplied by the air supply unit to a sealable and pressurized or non-pressurized powder toner repository is regulated and introduced to the powder toner fluidization unit in the powder toner repository so that the powder toner is fluidized in the powder toner repository; the powder toner repository is sucked through the suction inlet of a suction unit so that the fluidized powder toner is delivered; and after the pulsating flow is flattened or promoted for flat flow by a pulsating-flow buffering unit located downstream the suction unit, toner is discharged in a toner filling container.

The powder toner transferring method according to the first aspect, wherein the reciprocating-motion pump is a bellows pump.

The powder toner transferring method according to the first aspect, wherein the outlet of the reciprocating-motion pump is located below the suction inlet of the pump.

The powder toner transferring method according to the first aspect, wherein the inner diameter of the valve connecting the outlet of the reciprocating-motion pump is equal to or greater than the inner diameter of the toner transferring tube connected to the pump.

The powder toner transferring method according to the first aspect, wherein the suction unit sucks the powder toner without pressurization.

The powder toner transferring method according to the first aspect, wherein the powder toner repository is under pressure of 4 kPa or less.

The powder toner transferring method according to the first aspect, wherein the powder toner is sucked in any one of intermittent and continuous conditions.

The powder toner transferring method according to the first aspect, wherein the transferred amount of the toner is adjusted by controlling any one of the intermittent and continuous conditions.

The powder toner transferring method according to the first aspect, wherein the joint of the outlet of the reciprocating-motion pump with the toner transferring tube is smoothed.

The powder toner transferring method according to the first aspect, wherein a pulsating flow buffer is installed in the vicinity of the outlet of the reciprocating-motion pump.

The powder toner transferring method according to the first aspect, wherein the air supply unit comprises a gas generation unit, and a power source of 24 V to 220 V is used for the air supply from the gas generation unit.

The powder toner transferring method according to the first aspect, wherein the gas generation unit is a compressor.

The powder toner transferring method according to the first aspect, wherein the air supply unit and the suction unit use any one of solar-power generation and wind-power generation.

The powder toner transferring method according to the first aspect, wherein the air supply unit comprises a high-pressure gas cylinder.

The powder toner transferring apparatus according to a second aspect comprising: a sealable, pressurized or non-pressurized powder toner repository, a gas supply unit which supplies a regulated gas to the powder toner repository, a powder toner fluidization unit which is located in the powder toner repository and fluidizes the powder toner in the powder toner repository by letting out a distributed gas, an intermittent suction unit which intermittently discharges the fluidized powder toner in the powder toner repository by intermittently sucking the powder toner repository, and a pulsating flow buffering unit located at the downstream of the intermittent suction unit.

The powder toner transferring apparatus according to the second aspect, wherein the toner slot of a toner input unit of the powder toner repository is detachable; the powder toner fluidization unit in the powder toner repository and the gas supply unit are connected by a detachable gas supply line; the powder toner repository and the intermittent suction unit are connected with a detachable suction line; and the toner outlet is located at the end of the toner transferring tube at the downstream of the pulsating flow buffering unit.

The powder toner transferring apparatus according to the second aspect, wherein at least two of the gas supply tube, suction tube, pressure buffering tube located above the toner discharge pipe and the toner input unit are detachably integrated in the toner powder repository.

The powder toner transferring apparatus according to any one of the second aspect, wherein the gas supply tube, pressure buffer tube and the suction tube are detachably mounted on a fixing member, and the fixing member is installed on other than the lid of the powder toner repository.

The powder toner transferring apparatus according to the second aspect, wherein the gas supply unit, the intermittent suction unit and the pulsating flow buffer unit are detachably mounted in a case; the case is portable comprising a handle, and the case comprises on its surface any one of power supply connection unit and a switch unit to a power source of 24 V to 220 V for the gas supply unit and powder suction unit.

The powder toner transferring apparatus according to the second aspect, wherein the case further comprises a pulsating flow buffering unit housing space for housing the pulsating flow buffering unit, a tubular member housing space for housing a bundle of various tubular members and a power code housing space.

The powder toner transferring apparatus according to the second aspect, wherein at least a portion of the case is transparent such that a part of the inside of the repository may be visually observed, at least a portion of the powder toner repository is transparent such that the existence of the powder toner inside the repository may be visually observed, and the transparent portion of the case and the transparent portion of the powder toner repository are at least partially overlapping.

The powder toner transferring apparatus according to the second aspect, wherein the case comprises an openable and closable lid which may be opened while the powder toner transferring apparatus is in operation.

The powder toner transferring apparatus according to the second aspect, wherein the powder toner comprises an external additive, the volumetric average particle diameter of the toner is 2.5 μm to 15 μm, the absolute specific gravity of the toner is 1.02 to 1.45, and the bulk density of the toner is 0.20 $g/cm^3$ to 0.90 $g/cm^3$.

The powder toner transferring apparatus according to the second aspect, wherein the powder toner is volumetrically increased in the powder toner repository by a factor of 1.2 to 15 by a gas.

The powder toner transferring apparatus according to the second aspect, wherein the pulsating flow buffering unit is comprised of an inlet pipe of the fluidized toner, a toner discharge pipe which meets at a right angle and opens below the inlet pipe, and a pressure buffer pipe which is located above the toner discharge pip; the upper end of the pressure buffer tube is composed of a flexible material with no volumetric capacity at a down time; the buffering unit is composed of a pressure buffer pipe, a fluidized toner inlet pipe and a toner discharge pipe in descending order of the inner diameter of the tubes.

The powder toner transferring apparatus according to the second aspect, wherein the upper end of the pressure buffer pipe extends to the inside of the powder toner repository, connected to a fixing member located at the top of the powder toner repository such that the excess pressure generated in the repository during the toner transportation may be released.

A powder toner filling apparatus according to a third aspect comprises the powder toner transferring method according to any one of the second aspect.

The powder toner filling apparatus according to the third aspect, wherein the powder toner filling apparatus comprises multiple powder toner transferring units.

The powder toner filling apparatus according to the third aspect, wherein the powder toner filling apparatus interlocks a scale, which weighs a discharged toner, with the number of revolutions of the motor which controls the pump.

The powder toner filling apparatus according to the third aspect, which comprises a toner discharge pipe installed over the toner filling container without a direct contact with the container; and a degassing tube, which is a detachable hollow tube with both ends sealed in the toner filling container with its lower end composed of a porous material and the other end connected to a vacuum system, which is able to degas the air inside the toner filling container through the porous portion, wherein the fluidized toner is discharged by the drive of a bellows pump; at the same time as the discharge or after discharging a predefined amount, the toner filling container is deaerated through the ventilation tube, and a predefined mass of toner is filled in the toner filling container of a given volume.

The powder toner filling apparatus according to the third aspect, wherein a hopper whose opening is concentric with the opening of the powder toner filling container is placed on top of the powder toner filling container; the powder toner filling method comprises a toner discharge tube installed inside the hopper without direct contact with the hopper and a degassing pipe which is a detachable hollow pipe between the hopper and the toner filling container having both ends sealed with its lower end composed of a porous material and the other end connected to a vacuum system, which is able to degas the air inside the toner filling container through the porous portion; a toner which do cannot be filled in the powder toner filling container is overflowed in the hopper, and the toner is filled in the powder toner filling container by inserting the degassing pipe after discharging a predefined amount of toner.

The powder toner filling apparatus according to the third aspect, wherein the toner discharge pipe is inserted closed to but not touching the bottom of the powder toner filling container; a predefined mass of toner is discharged at once or more than once with degassing operation in between with the toner discharge pipe immersed in the toner; after a certain mass is reached, the toner discharge pipe is pulled up close to the inlet of the toner filling container; the discharge may be continued until the value of the weight indicator reaches the set value while the toner discharge pipe is not in contact with the toner powder and the powder toner cartridge.

The powder toner filling apparatus according to the third aspect, wherein a degassing unit concentric with the toner discharge pipe is located outside the toner discharge pipe; using a filling nozzle comprising the degassing unit whose toner discharge tube has a lower end formed by a porous material, the toner filling nozzle is inserted closed to but not touching the bottom of the powder toner filling container, and a predefined mass of toner is discharged; while discharging or after alternatively discharging and degassing, the filling nozzle is pulled up close to the inlet of the toner filling container for additional discharge; having signaled that the filling is completed, the degassing unit is depressurized to suck the powder toner in the toner discharge pipe to the inner wall of the degassing unit and form plugs, and filling terminates.

The powder toner filling apparatus according to the third embodiment, wherein the reverse air pressure and the air flowrate are independently controlled for the prevention of clogging the degassing unit and the plug formation unit.

The powder toner filling apparatus according to the third embodiment, wherein a pressure sensor is installed perpendicularly at the discharge side of a bellows pump which sucks and discharges the fluidized toner, or at the assembly part of the bellows discharge tubes when multiple bellows are comprised in one toner transportation mechanism; the toner discharge pressure may be continuously measured; the filling is asserted at a pressure greater than a certain level, and a caution or warning is issued.

A powder toner filling method according to a fourth aspect comprises the powder toner transferring method according to the first aspect.

The powder toner filling method according to uses a powder toner filling apparatus, which comprises a toner discharge pipe installed over the toner filling container without a direct contact with the filling container; and a degassing tube, which is a detachable hollow tube with both ends sealed in the toner filling container with its lower end composed of a porous material and the other end connected to a vacuum system, which is able to degas the air inside the toner filling container through the porous portion, wherein the fluidized toner is discharged by the drive of a bellows pump; at the same time as the discharge or after discharging a predefined amount, the toner filling container is deaerated through the ventilation tube, and a predefined mass of toner is filled in the toner filling container of a given volume.

The powder toner filling method according to uses a powder toner filling apparatus comprising a hopper and a powder toner filling container, wherein the hopper whose opening is concentric with the opening of the powder toner filling container is placed on top of the powder toner filling container; the powder toner filling method comprises a toner discharge tube installed inside the hopper without direct contact with the hopper and a degassing pipe which is a detachable hollow pipe between the hopper and the toner filling container having both ends sealed with its lower end composed of a porous material and the other end connected to a vacuum system, which is able to degas the air inside the toner filling container through the porous portion; a toner which do cannot be filled in the powder toner filling container is overflowed in the hopper, and the toner is filled in the powder toner filling container by inserting the degassing pipe after discharging a predefined amount of toner.

The powder toner filling method according to uses a powder toner filling apparatus comprising a toner discharge pipe and a powder toner filling container, wherein the toner discharge pipe is inserted closed to but not touching the bottom of the powder toner filling container; a predefined mass of toner is discharged at once or more than once with degassing operation in between with the toner discharge pipe immersed in the toner; after a certain mass is reached, the toner discharge pipe is pulled up close to the inlet of the toner filling container; the discharge may be continued until the value of the weight indicator reaches the set value while the toner discharge pipe is not in contact with the toner powder and the powder toner cartridge.

The powder toner filling method according to uses a powder toner filling apparatus comprising a toner discharge pipe and a powder toner filling container, wherein a degassing unit concentric with the toner discharge pipe is located outside the toner discharge pipe; using a filling nozzle comprising the degassing unit whose toner discharge tube has a lower end formed by a porous material, the toner filling nozzle is inserted closed to but not touching the bottom of the powder toner filling container, and a predefined mass of toner is discharged; while discharging or after alternatively discharging and degassing, the filling nozzle is pulled up close to the inlet of the toner filling container for additional discharge; having signaled that the filling is completed, the degassing unit is depressurized to suck the powder toner in the toner discharge pipe to the inner wall of the degassing unit and form plugs, and the filling terminates.

The powder toner filling method according to claim wherein the reverse air pressure and the air flowrate are independently controlled for the prevention of clogging the degassing unit and the plug formation unit.

The powder toner filling method according to uses a powder toner filling apparatus comprising a toner discharge pipe and a powder toner filling container, wherein a pressure sensor is installed perpendicularly at the discharge side of a bellows pump which sucks and discharges the fluidized toner, or at the assembly part of the bellows discharge tubes when multiple bellows are comprised in one toner transportation mechanism; the toner discharge pressure may be continuously measured; the filling is asserted at a pressure greater than a certain level, and a caution or warning is issued.

The transferring method and the transferring apparatus of a powder toner of the present invention exert a beneficial effect that the quality of the toner is preserved since the powder toner is not under stress.

The apparatus is reduced in size and weight and portable since the toner scattering is prevented and pressurization is unnecessary; moreover, the apparatus may be used for all types of power sources. Therefore, on-demand use in an office is possible.

The conventional pneumatic transporting method, which premises pressurization, requires about 15 L/min of gas supply to avoid the performance degradation of a toner due to mechanical stresses such as agitation and pressurization when screw conveyer and mechanical pumping method are used. However, the transferring method of the present invention requires no pressurization, and the amount of suction gas is about one fifth of that with pressurization. Accordingly, the transferring method of the present invention gives the following benefits: reduced size and weight of the apparatus, and portability; short rise time from the start-up of the apparatus to a toner discharge; short degassing period and settling period; avoidance of unwanted agitation of the toner; prevention of the quality degradation; short toner transferring time and the toner filling time; reduction in the required space and electrical power; few pre-operations and post-operations; and low cost.

The bulk density of a fluidized toner according to the present invention is approximately 0.33 g/cc, which implies a significant reduction in terms of volume requirement. The difference is largely in the volume of supplied gas, i.e. suction volume. Also, the stress on the powder toner is reduced since it is not pressurized during transportation. In addition, the fluidized bed increases the transfer performance by a factor of three to four compared to a transfer process only with a gas supply.

Also, the toner transfer in a powder toner filling apparatus of the present invention is typically driven by a motor, and an accurate filling is achieved by varying the torque (the supplied amount of current), especially the number of revolutions (for example, the frequency in inverter control and the number of pulses and intervals in pulse control) with respect to the filling amount, where the filling amount is monitored, and the obtained information is fed back to the control parts of the control circuit in the motor and the power supply circuit. In addition, a filling nozzle is inserted near the bottom of a container, and the degassing effect may be combined with the control of the toner transfer speed. This allows a filling in a container with a small volume. Furthermore, even a filling in a flexible container may be completed in a short period of time without toner scattering with the addition of a mechanism of forming a 'plug' inside a toner transferring pipe.

Figure 1:
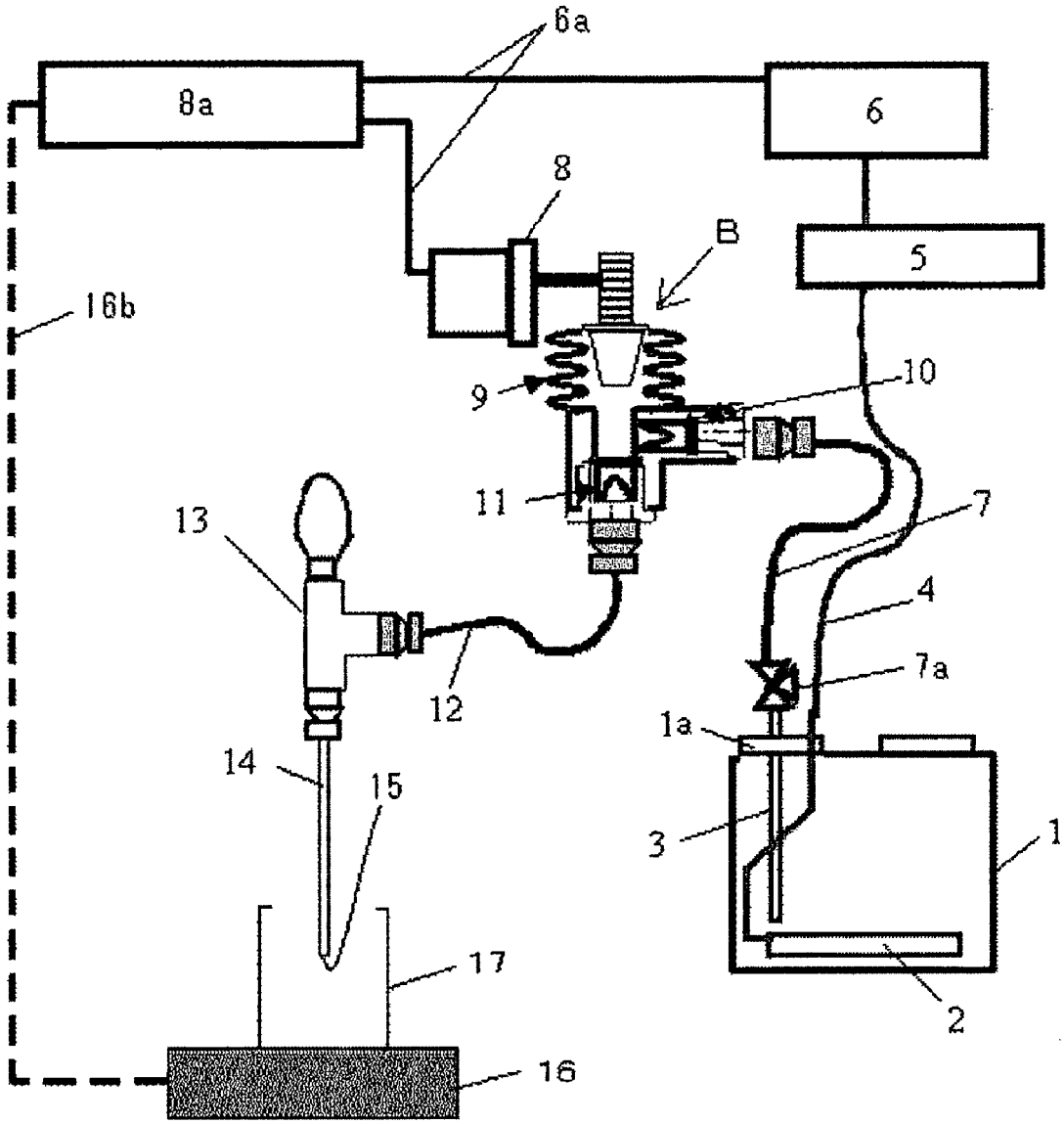
FIG. 1 is an exemplary diagram schematically showing the toner transferring apparatus of the present invention.

BEST MODE FOR CARRYING OUT THE INVENTION (Powder Toner Transferring Method and Powder Toner Transferring Apparatus)

A powder toner transferring method of the present invention fluidizes a powder toner by a gas supplied from a gas supply unit to a powder toner repository, sucks the fluidized powder toner by unit of a suction means unit and transfers the powder toner by discharging the toner into a toner storage container, wherein the suction of the powder toner with a suction unit is performed with a reciprocating-motion pump.

A preferable aspect in this case is the following: the gas supplied by the air supply unit to a sealable, pressurized or non-pressurized powder toner repository is regulated and introduced to the powder toner fluidization unit in the powder toner repository so that the powder toner is fluidized in the powder toner repository; the powder toner repository is sucked through the suction inlet of a suction unit so that the fluidized powder toner is delivered; and after the pulsating flow is flattened or promoted for flat flow by a pulsating-flow buffering unit located downstream the suction unit, toner is discharged in a toner container.

A powder toner transferring apparatus of the present invention comprises: a sealable powder toner repository which is pressurized or non-pressurized, a gas supply means to supply a regulated gas into the powder toner repository, a powder toner fluidization means which is located in the powder toner repository and fluidizes the powder toner in the powder toner repository by letting out a distributed gas in the powder toner repository, an intermittent suction means which intermittently sucks the powder toner repository and intermittently discharges the fluidized powder toner in the powder toner repository, and a pulsating flow buffering unit located at the downstream of the intermittent suction unit;

the powder toner transferring apparatus optionally comprises other units.

The suction unit sucks a powder toner by a reciprocating-motion pump. The 'reciprocating-motion pump' does not mean a 'reciprocating pump,' which internally comprises an reciprocatingly-moving member such as rod, which transfers a powder by reciprocation of a plunger or a piston that mechanically pressurizes as well as pushes the powder toner or by penetration into and agitation of the powder phase. Therefore, the pump is not referred to as a 'reciprocating pump' but expressed distinctively as a 'reciprocating-motion pump.' Among such 'reciprocating-motion pumps,' a bellows pump (an accordion pump) is the most preferable since the bellows pump, with both ends unfixed, is capable of handling a low-speed discharge. In other words, the bellows pump discharges the toner with a slow movement without stressing the toner, and it is superior in terms of energy efficiency.

An intermittent suction may be easily performed by using a reciprocating-motion pump for the suction of a powder toner, and powder blockage does not occur with such intermittent suction. Also, regarding the positional relationship between the suction port and discharge port of the fluidized toner, the suction pipe is located at a higher elevation, and the toner is discharged through a pulsating flow buffering unit, which are interdependently effective in preventing the scattering of the powder toner.

Herein, the intermittent adjustment according to the present invention means, for example, the adjustment of the transfer amount, transfer period and transfer time by controlling the amount, frequency, time of a stroke. This may successfully smooth the transfer and prevent the transfer interruption as well as pulsation, or at least reduce the dependence on the pulsating flow buffering apparatus.

Also, the powder toner transferring apparatus of the present invention does not require pressurization during the transfer of a powder toner. Therefore, supplement of powder during the operation, and accordingly a continuous operation, is possible. In order to facilitate or promote the outflow of the powder from the powder toner repository by means of suction, supplementary gas supply, i.e. pressurization, to preferably the inside of the powder phase of the powder toner repository is recommended. As a specific example, pressurization of 4 kPa or less improves the outflow of the toner.

Patent literatures such as JP-A No. H04-226672 (JP-B No. H06-14960) and JP-A No. 2000-329068 disclose bellows pumps (accordion pumps). The descriptions in these publications are related to liquid transfer instead of powder transfer, yet it is still helpful in understanding the structure of the bellows pump.

Specifically, a bellows pump pulsatingly sucks the transferring fluid by means of an expansion and contraction of the bellows (bellowphragm). In other words, the expansion of the compressed bellows opens an inlet valve and closes the outlet valve, and the transported fluid is sucked inside the bellows under reduced pressure; the bellows being compressed closes the inlet valve and opens the outlet valve, and it hence exhausts the transported fluid through the outlet valve.

The intermittent condition of this intermittent suction pump, depending on the internal diameter of bellows, is preferably three strokes per minute to 130 strokes per minute for bellows with small diameter, and more preferably 40 strokes per minute to 100 strokes per minute. Also, for the case of bellows with large diameter, it is preferably six strokes per minute to 70 strokes per minute, and more preferably 40 strokes per minute to 60 strokes per minute. Higher suction performance may be obtained with bellows having larger capacity; therefore, the fewer number of strokes suffices, and the transfer amount may be adjusted by controlling the pump stroke and the number of strokes. However, it should be noted, in terms of determining the capacities of the intermittent suction pump and the pulsating flow buffering unit, that bellows capacity and the number of strokes constrain the buffer capacity necessary for pulsating flow buffering unit. Suction takes place between the powder toner repository for toner fluidization and the pump. The effect of the suction according to the present invention is the toner transportation and the prevention of toner scattering. The transportation from the pump to the cartridge is equivalent to discharge, which is an intermittent operation. Therefore, the fluidized toner is moved at a varying speed depending on the rotation of the pump in the pump and on the transport path, which gives an agitating effect to the toner and prevents the precipitation of the toner in the pathway. When the operation is not intermittent, there is no speed difference of the toner in the pathway. The toner settles and deposits there, which becomes an agglomeration of the toner. This causes a defective transfer of the toner in the pathway and hence a defective image at image formation, so-called a black void.

In general, the bellows pump is used when a liquid is pumped from a lower position to an upper position. Since it is naturally possible to transport liquid from an upper position to a lower position by gravity, a bellows is generally used upward (an ordinary orientation) so that the bellows is located below the inlet and outlet valves. When a powder toner is transferred, the accumulation of the toner within the bellows and the clogging of the powder toner improve by placing the bellows over the inlet and outlet valves (in a reverse orientation). The clogging of the powder toner also improves when the internal diameter of at least the toner discharge pipe connecting the bellows pump and the pulsating flow buffering unit among the toner discharge pipes (a connection to the outlet of the bellows pump, referred also in the present description to as connector lines or toner tubes) is equal or larger than the internal diameter of the bellows pump.

In addition, the use of duckbill valves for the inlet and outlet valves forces the flow in one direction as well as reduces the stress on the toner in the solid-gas mixed flow comprising the toner and air in the tubes.

By combining the duckbill valves and a bellows pump, the residual toner within the apparatus is only at the clearance between the outlet part of the duckbill valve and the pump, which makes the cleaning operation of the apparatus extremely easy.

In case of an intermittent operation by means of a bellows pump, the suction of the powder toner is performed intermittently, and discharge is also performed intermittently, which cause a toner scattering. Therefore, in the present invention, a pulsating flow buffering unit is employed in the case of a pump with only one bellows. Installation of a pulsating flow buffering unit at the discharge part of the toner (transferring part) reduces the pulsation, which avoids the toner scattering as well as reduces the stress on the toner. Here, a buffering unit is a mechanism to release the excess pressure and to retain the powder temporarily.

According to the present invention, the powder toner transporting apparatus is not largely pressurized; hence, a power source of 24 V to 220 V is applicable. A high-pressure gas cylinder may be used for the gas supply part; it is also possible to use a battery as well as natural energy such as solar-power generation and wind-power generation.

Here, FIG. 1 is a schematic diagram exemplarily showing a powder toner transferring apparatus of the present invention.

The powder toner transferring apparatus is such that a transferring means roughly divided into a powder toner suction part, i.e, suction unit, and a powder toner supply part, i.e. supply unit, placed in a toner repository 1.

The powder toner suction part comprises a bellows pump B as an intermittent suction pump and a pulsating flow buffering unit (a pulsating flow buffer) 13. The inlet part or the suction source part, comprising an inlet valve 10 of the bellows pump B and the toner repository 1, is connected with a toner suction tube 7 (a toner tube 7). The outlet part, comprising an outlet valve 11 of the bellows pump B and the pulsating flow buffer 13, are connected with a toner discharge pipe 12 (a toner tube 12). This exemplary apparatus has a pulsating flow buffer 13, but it is not mandatory according to the present invention (a smoothed transfer in FIG. 6 should be referred).

Also, this example has a three-way valve 7*a* installed in the toner tube 7.

A toner discharge pipe 14 is located at the outlet of the pulsating flow buffer 13, and its downstream end has a toner filling container 17 in which the transferred toner is filled.

The toner filling container 17 is placed on a scale 16, which is installed on an electromagnetic diaphragm (not shown). This diaphragm is a transducer that varies the output electric potential from the secondary coil depending on the degree of strain (the degree of stretch). The output signal from this is transmitted to the power control circuit 8*a* through a signal line 16*b*.

The power control circuit 8*a* of the present exemplary toner transporting apparatus comprises a one-chip microcomputer, which comprises: a CPU; an ROM that stores at a call ready state a program for operation and dispatch of the command signals as well as threshold data thereby; and a RAM that stores at a write ready state a monitor signal information encoded by an encoder and momentarily transmitted from the signal line 16*b*. Operations or comparisons of the threshold data called from the ROM and the monitor signal information called from the RAM are repeated on the CPU until the difference thereof becomes zero, and the result of the operation is stored again at a call ready state in a RAM. At the same time, the control signals corresponding to the operational results are decoded, and transmitted successively (and more frequently near the end of the filling) to the controller of the power control circuit 8*a*. However, the control system of the present invention is not restricted to that described above, and any heretofore known control system is applicable.

The powder toner supply part comprises: a compressor apparatus 6 as a supply unit and a fluidized bed 2 as a unit to fluidize a powder, wherein the fluidized bed 2 is comprised in the powder toner repository; the compressor apparatus 6 and the fluidized bed 2 are connected with a gas supply tube 4, and a flowmeter 5 is installed in the middle of the gas supply tube 4.

The exemplary apparatus is composed of: (i) the powder toner repository 1 comprising the fluidized bed 2 as an exemplary unit to fluidize a powder; (ii) the compressor apparatus 6 as an exemplary gas supply unit; (iii) the bellows pump B as an exemplary intermittent suction pump; (iv) the pulsating flow buffering unit (a pulsating flow buffer) 13; (v) a fixing means 1*a* located at the entrance end of the gas introducing unit; (vi) a gas supply regulating unit (not shown); and (vii) a suction line 14 as an exemplary powder toner discharge unit.

The bellows pump B, comprising a bellowphragm 9, an inlet valve 10 and an outlet valve 11, is driven by a pump motor 8. In this example, the gas supply regulating unit is installed in the compressor 6, or more precisely in the power control circuit 8*a* of the motor for the compressor.

The flowmeter 5 is attached to the compressor apparatus 6. The fluidized bed 2 in the powder toner repository 1 and the gas supply unit are connected with a detachable gas supply tube 4 as a supply line, and the powder toner repository 1 and the bellows pump B is connected with a detachable toner tube 7 as a suction line. The pulsating flow buffering unit 13 is installed at the toner tube 12 as a toner transferring line at the downstream of the bellows pump B. The toner transferring tube is extended to the downstream side of the pulsating flow buffering unit 13, and a toner outlet 15 exists at the end thereof. The suction line 7 is, in this example, extended deep inside the powder toner repository 1, 10 mm to 30 mm above the fluidized bed via toner suction pipe 3.

In this example, a fixing unit 1*a* is other than the lid member of the powder toner repository 1. The gas supply tube 4, the suction tube 7, and a vent tube are detachably mounted to the fixing unit 1*a*; at least two of the gas supply tube 4, the suction tube 7 and the vent tube are preferably integrated at a detachable state. The gas supply line 4, the suction line 7 and the vent tube may be made of the same materials.

The fixing member 1*a* of the present example is a joint member to the ceiling of the powder toner repository 1. To this member, a gas supply line is detachably attached as well as a suction line from the bellows pump B as an example of the intermittent powder toner suction unit (intermittent suction pump) is detachably attached. A small hopper as a unit to supply a powder toner is detachably attached to the lid member to which nothing is connected; therefore, a toner may be easily supplied through this lid member.

The use of such a toner repository is not the essential part of the present invention but one preferable exemplary aspect. For example, when a toner is supplied on a very short notice to the powder toner repository 1 during an operation, it may be switched to another supply unit with higher supply performance, or another supplementary unit may be used in combination.

The powder toner transferring apparatus of the present invention may operate under no pressurization; therefore, there is no problem with the supplement of toner during the operation, which also applies to other configurations. For example, the flowmeter 5 attached to the middle of the gas supply line from the compressor apparatus 6 as the exemplary gas supply unit which comprises the flowmeter is not mandatory in the present invention. Any unit that regulates the gas supply may be used, and furthermore the compressor apparatus 6 itself is simply an example of the gas supply unit. Therefore, a high-pressure gas cylinder may be used as a gas generation or a gas supply mechanism in the place of the compressor.

Further explanation of the exemplary apparatus follows that the toner in the powder toner repository 1 is fluidized by suction from the suction pipe 7 through the fluidized bed 2 in combination with the regulated air from the compressor 6 as well as a supplementary gas supply from compressor 6. In other words, the pressurization for the gas supply in the present invention complements the suction by suction tube 7. The fluidized toner is then sucked from the inlet valve 10 by the extension and contraction of the bellows in the pump unit; it passes through the outlet valve 11 and the toner transfer line (toner tube) 12 and is discharged from the outlet 15 of the toner transfer pipe 14. A pulsating flow buffer 13 is inserted in the middle for the purpose of easing the pulsating flow of the toner. The buffer 13 is used before the discharge because toner scattering is prone to occur.

The pulsating flow originated from the bellows pump may be significantly buffered also by lengthening the toner transfer path after the bellows pump; the adoption of this kind of measure is not completely excluded in the present invention. However, the countermeasure of simply increasing the length of the toner transfer path to resolve the pulsating flow increases the wait time from the start-up of the powder toner transferring apparatus to a toner discharge as well as the frictional resistance in the toner transfer path; therefore, it is not the best solution to the problem.

The volumetric average particle diameter of the powder toner used in the present invention is preferably 2.5 μm to 15 μm, more preferably 3.0 μm to 12.0 μm, and even more preferably 5.0 μm to 9.0 μm. The absolute specific gravity of the toner is preferably 1.02 to 1.45, and more preferably 1.1 to 1.3. The bulk density of the toner is preferably 0.20 g/cm$^3$ to 0.90 g/cm$^3$, and more preferably 0.35 g/cm$^3$ to 0.85 g/cm$^3$. The toner impregnated with an external additive shows an especially significant effect.

The amount of air from the compressor 6 is such that the volume of the toner in the powder toner repository 1 is increased by a factor of 1.2 to 15, and more preferably 1.5 to five. More than the amount specified above is unnecessary. The bulk density of the toner, which is about 0.47 g/cm$^3$ at the beginning, decreases to 0.25 g/cm$^3$ right after the transfer due to the introduction of a gas. However, since the bellows pump B has a superior ability in terms of transferring a powder compared to other types of pumps, it is not necessary to operate solely with such a low density as long as the apparatus is operated such that the clogging of the toner in the transfer path is avoided. More specifically, the toner may be transferred with a bulk density as high as about 0.35 g/cm$^3$. The bulk density of the fluidized toner of the present invention is about 0.33 g/cm$^3$, and the volume reduction is significant compared to the conventional methods. This is largely due to the difference in the amount of gas supply, or the gas intake. Also, the stress on the powder toner is reduced because the powder toner is not pressurized during the transfer. In addition, the presence of the fluidized bed increases the transfer ability of the powder toner by a factor of three to four in comparison to the case with gas supply only.

Figure 2:
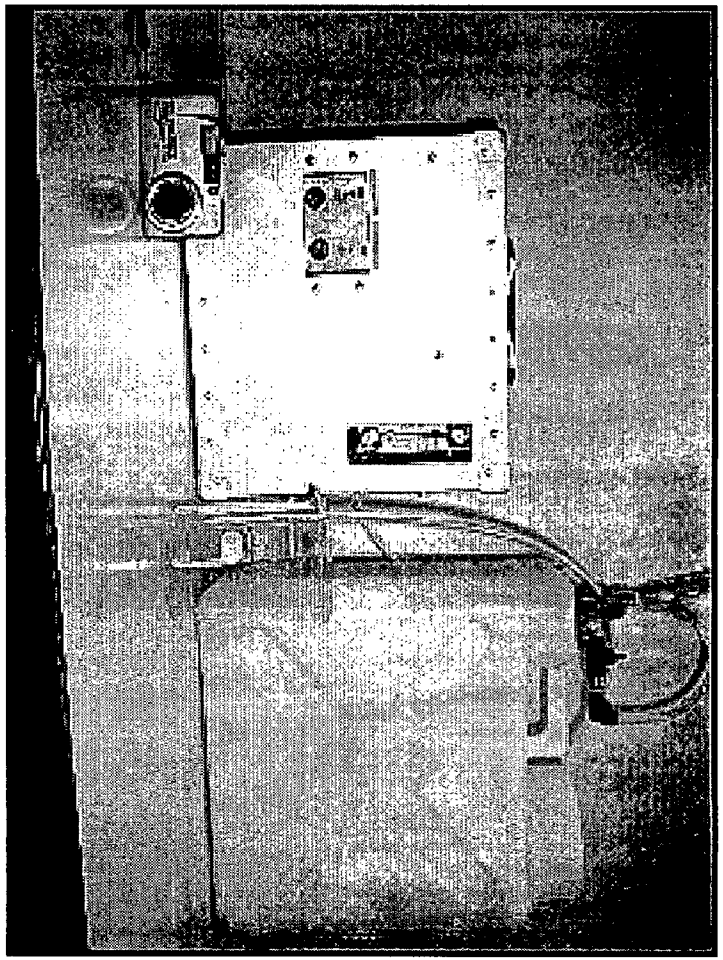
FIG. 2 is a photograph showing on the left an example of an external appearance of a portable toner filling apparatus of the present invention and on the right a fluid tank.
Figure 3:
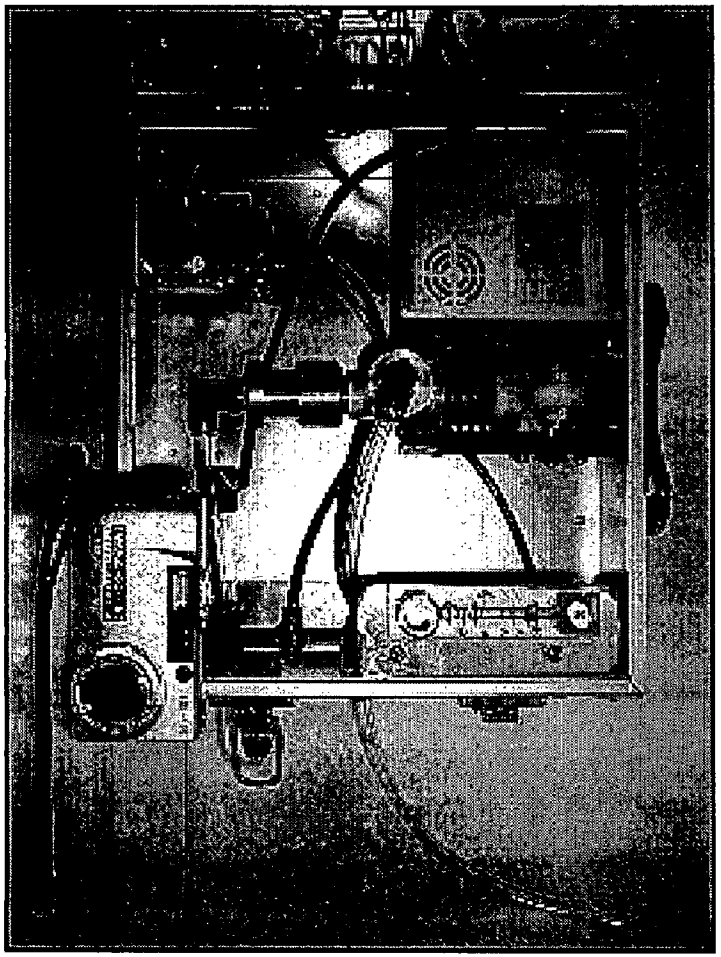
FIG. 3 is a photograph showing an internal view of the toner filling apparatus of FIG. 2.

FIG. 2 is a photograph showing a set of a powder toner filling apparatus comprising the powder toner transferring apparatus of the present invention, which is stored in a portable case. In addition, FIG. 3 is a photograph showing an example of the actual storage condition. The case is portable, comprising a handle, and it comprises on its surface a connection unit to a 24 V to 220 V power supply for the gas supply unit and the powder suction means as well as a switching unit. The dimension of the case in the present example is 400 mm long, 300 mm wide and 160 mm deep; all the equipments such as compressor 6, bellows pump B, pulsating flow buffering means 13, tubular members connecting thereof and the electrical code for connecting the power supply are detachably stored or mounted. As shown in FIG. 3, the tubular members are fixed so that they are not tangled.

This portable case may be opened during the operation of the toner filling apparatus, but the inside of the case may be visually observed even with the case closed since there is an observation window allocated as shown in FIGS. 2 and 3. Also, the powder toner repository in this exemplary apparatus is transparent enough to visually observe the presence of the powder toner inside, but an observation window may be installed on the powder toner repository 1. It is confirmed that the transparency may be maintained for a long period of time by the application of a fluorinated stain-proofing agent or a silicone stain-proofing agent.

In the powder toner transferring apparatus of the present invention, the resistance at the inner wall of the transfer path is preferably low mainly from the viewpoint of the prevention of the decrease in the quality of the transported toner rather than the transfer properties. Therefore, preferably the inner wall of the transfer path is smooth, and more preferably fittings are as flat as possible. The level of flatness at the fittings is preferably equivalent to the smoothness of the surface of a resin film such as the surface of a commercially-available PET film with which a significant amount of inorganic filler particles are usually kneaded. In addition, as mentioned above, the clogging of the powder toner improves when the inner diameter of the valve in the bellows pump is equal to or larger than the inner diameter of the connecting line connecting the pulsating flow buffering unit, toner suction tube and the toner discharge pipe. A duckbill valve manufactured by Vernay Europa V.B. in the Netherlands is employed as a valve in the powder toner transferring apparatus shown in FIG. 1.

Next, the improvement of the filling accuracy and efficiency is explained.

The scale 16 is placed below the toner discharge outlet of the powder toner transferring apparatus shown in FIG. 1, and the scale is interlocked with the pump motor 8 as described above. This gives a finer control in the present invention that the filling amount may be controlled up to a precision of 0.1 g while in the conventional method of powder fluidization, according to JP-B No. 3549053, the filling amount may be controlled up to the range of 0 g to 10 g. In other words, the present invention gives a hundredfold accuracy compared to conventional equivalents.

The conventional filling apparatus controls the amount of powder only by sealing and pressurizing the powder; therefore, it is difficult to perform pressurization with large conditional changes.

On the other hand, the powder is not required to be sealed in the present invention, and a gas is supplied only for the fluidization of the toner. Therefore, the toner powder is controlled only by the movement of the pump, which is easily done by interlocking it with the scale. More specifically, the rotational speed of the motor is controlled stepwise or non-stepwise. In particular for pulse motor drive, the pulse motor is turned off before the filling amount meets the target. The actual filled amount and the amount of the delivered pulse are compared, and discrepancy between the objective filling amount and the actual filling amount is transformed to a pulse signal, which is sent to the pulse motor. By this, a high-accuracy filling and high-speed filling are compatible.

The improvement of the filling efficiency is possible by installing multiple toner ejection parts comprising pump motors. Instead of intermittent toner discharge by pressurization of fluidized powder, toner discharge and pressure release, a continuous operation from the start-up of the toner filling to shut-down by turning on and off the pump motor is possible. This allows a continuous automatic operation.

One operation performs only one filling in the conventional fluidized filling method. However, in the present invention, multiple toner suction parts and discharge part of the toner are located to allow filling operation from one toner repository to multiple toner containers.

Figure 4:
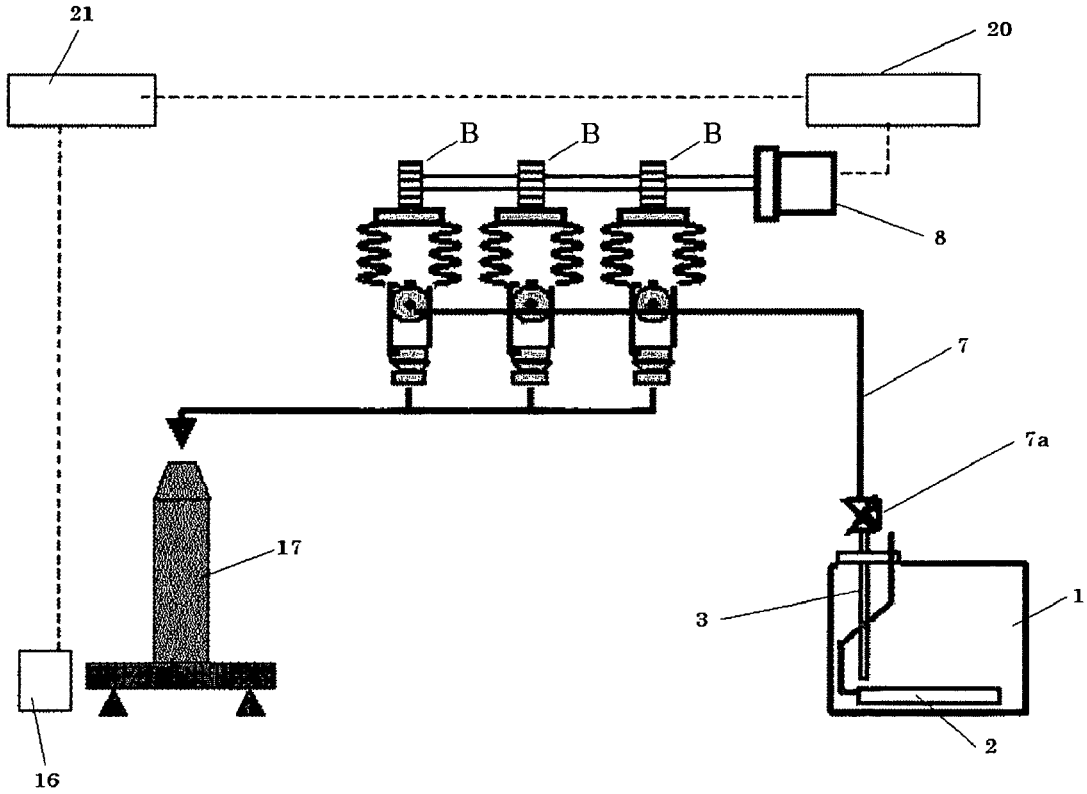
FIG. 4 is another exemplary diagram schematically showing the toner transferring apparatus of the present invention.

Furthermore, as shown in FIG. 4, the pulse of powder may be buffered by arranging three bellows pumps B. Therefore, the pulsating flow buffer 13 shown in FIG. 1 is no longer necessary, and a filling with higher accuracy is possible.

In FIG. 4, the apparatus comprises a pump controller 20 and an overall controller 21. Other members, which are equivalent to those in FIG. 1, have equal reference codes, and the descriptions thereof are omitted.

The dimension and the flow of a transferring apparatus with a discharge ability of 250 g/min are shown as a specific example.

The transferring apparatus has a compressor, a powder pump, piping and instrumentations placed in an aluminum-alloy trunk of 40 cm long, 30 cm wide and 16 cm deep, driven by a 100-V power supply. A toner discharge may be started about two minutes after the installation of the apparatus.

The discharge ability may be increased by an addition of bellows and enlargement of the diameter.

In the case of conventional method, the number of cartridges that may be filled from one toner repository is limited because the apparatus is pressurized.

On the other hand, in the present invention, powder may be added during the operation since the apparatus is not pressurized. The present invention may be applied also to the addition of the toner. Moreover, it is beneficial that toner scattering is reduced because the toner discharge speed may be controlled by the rotational speed of the pumps.

(Powder Toner Filling Apparatus and Powder Toner Filling Method)

The powder toner filling apparatus of the present invention comprises the powder toner transferring means of the present invention and optionally other means as required.

The powder toner filling method of the present invention comprises the powder toner transferring process of the present invention and optionally other processes as required.

In the powder toner filling method of the present invention, a toner fluidized by the drive of a bellows pump is discharged in a toner cartridge; at the same time as the discharge or after discharging a certain amount, the air in the toner is removed through the degassing tube so that the toner with a constant mass may be filled in a toner cartridge with a given volume.

In the powder toner filling method of the present invention, the toner that cannot be filled in a powder toner cartridge may be overflowed in a hopper. A toner discharge with a constant mass is followed by the insertion of the degassing tube to store the toner in the powder toner cartridge.

In the powder toner filling method, a toner discharge pipe is inserted close to but not touching the bottom of the powder toner cartridge, and a predefined mass of toner is discharged at once or more than once with degassing operation in between with the toner discharge pipe immersed in the toner. After a certain mass is reached, the toner discharge pipe is pulled up close to the inlet of the toner cartridge. The discharge may be continued until the value of the weight indicator reaches the set value while the toner discharge pipe is not in contact with the toner powder and the powder toner cartridge.

In the powder toner filling method, a degassing unit concentric with the toner discharge pipe is located outside the toner discharge pipe; using a filling nozzle comprising the degassing unit whose toner discharge tube has a lower end formed by a porous material, the toner filling nozzle is inserted closed to but not touching the bottom of the powder toner container, and a predefined mass of toner is discharged; while discharging or after alternatively discharging and degassing, the filling nozzle is pulled up close to the inlet of the toner container for additional discharge; having signaled that the filling is completed, the degassing unit is depressurized to suck the powder toner in the toner discharge pipe to the inner wall of the degassing means and form plugs, and the filling terminates.

In the powder toner filling method, the reverse air pressure and the air flowrate are independently controlled for the prevention of clogging the degassing means and the plug formation means.

In the powder toner filling method, a pressure sensor is installed perpendicularly at the discharge side of a bellows pump which sucks and discharges the fluidized toner, or at the assembly part of the bellows discharge tubes when multiple bellows are comprised in one toner transportation mechanism; the toner discharge pressure may be continuously measured; the filling is asserted at a pressure greater than a certain level, and a caution or warning is issued.

Herein, a high-density filling method to a flexible container described in patent literatures such as JP-A No. 2004-78252 is explained.

Figure 8:
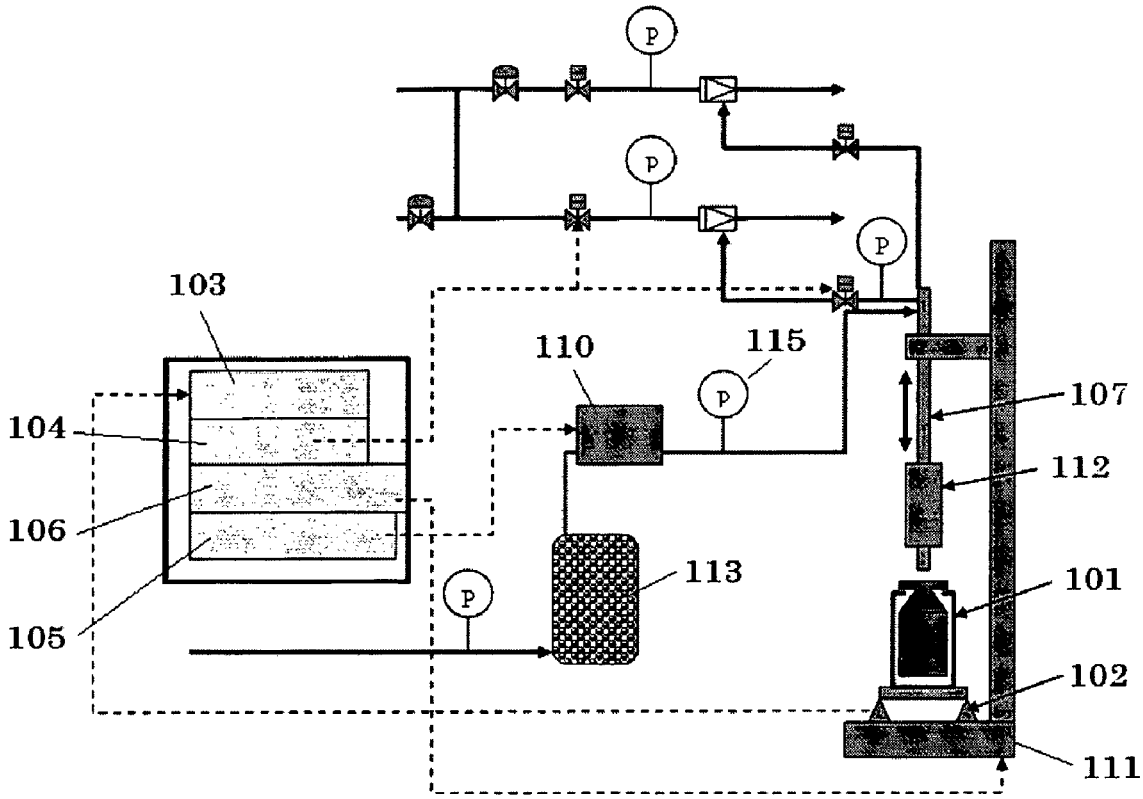
FIG. 8 is a schematic diagram of a high-density filling method with a flexible container according to the present invention.

FIG. 8 is a schematic diagram showing an example of a high-density filling apparatus to a flexible toner. This high-density filling apparatus is comprised of the following four units: (1) a transfer unit which fluidizes a toner and transfers it to a filling nozzle; (2) an air instrumentation unit which controls the pressure of the degassing mechanism and the closing mechanism in the filling nozzle; (3) filling and degassing nozzle unit; and (4) an overall control unit.

(1) The transfer unit comprises: a fluidized bed 113; a filling apparatus 110 which transfers the fluidized toner; and a line pressure sensor 115 which measures the transferring pressure of the fluidized toner. These are connected with tubes or piping.

(2) The filling and degassing nozzle 107 in the air instrumentation unit forms a multiplexed tube comprising a concentric inner tube, middle tube and outer tube (not shown). The fluidized toner flows inside the inner tube. As an air pathway for degassing and closing the toner, the lower end of the exterior of the outer tube for degassing and the lower end of the interior of the inner tube for closing are covered with a porous material such as stainless mesh, sintered material and porous plastic, which enables to control the pressure in the space surrounded by the outer tube and the middle tube and by the middle tube and the inner tube, respectively. They are connected to the air instrumentation composed of multiple external electromagnetic valves.

(3) The filling nozzle unit comprises: a height adjustment mechanism 111 which controls the height of the filling and degassing nozzle based on the filling amount and the height of the container; a holder 111 of the toner container; a load cell 102 which is a measuring sensor for the toner container and the filling amount; and a nozzle cleaner 112 which is located outside the filling nozzle without contacting and performs vacuum cleaning of the toner adhered outside the filling nozzle.

(4) The overall control unit comprises: a weight indicator 103 which displays the signal from the load cell as a weight; a DC motor drive 105 which controls the rotational speed of the filling apparatus; a controller 106 for the height-adjustment mechanism; and a Programmable Logic Controller (PLC) 104 which collectively controls the controller thereof.

After a toner to be filled is placed in the fluidized bed and fluidized, an empty flexible container is placed to the container holder 101, and a filling start-up signal is given. The filling and degassing nozzle 107 is positioned with its lower end close but not touching to the bottom of the flexible container by the filling nozzle height adjustment mechanism. Then, the completion of the positioning is signaled to the PLC 104. After the container is tared by the load cell 102 and the weight indicator 103, the toner is transferred from the fluidized bed 113 to the filling and degassing nozzle 107 with a preset rotational speed of the filling apparatus 110. The filling is interrupted when the weight is such that the transferred toner does not overflow the container (although the interruption is not mandatory), and degassing takes place for a certain period of time through the porous plate of the exterior of the nozzle. After the degassing period is completed, the negative pressure for degassing is released, and the filling and degassing nozzle 107 is moved above so that its lower end is positioned near the top of the toner container. Filling is performed at this location with a moderate speed or a low speed for the preset filling amount.

When the low-speed filling is completed or the mass of the filled toner is one gram to a few grams short of the preset filling amount, the pressure between the inner tube and the middle tube is a negative pressure of about −5 kPa. With this pressure, the fluidized toner and the air are sucked through the porous plate on the interior of the inner tube. Therefore, the toner is sucked to the tube wall of the inner wall, forming plugs to stop the flow. Because the flowrate in the tube is reduced by setting a low rotational speed of the filling apparatus 110, the flow of the toner may be stopped with a minor negative pressure of about −5 kPa, and the resulting so-called plugs are not robust. At the beginning of the next filling operation, the plugs are broken or flushed over time with a pressure of about 5 kPa, causing no toner scattering due to the destruction of the plugs, which is often the case with conventional means. In addition, the plugs of the toner is maintained by maintaining this negative pressure till the next filling operation, which prevents the dripping of the toner.

In a conventional means, a hopper is placed on top of the flexible container to expand the volume of the container. The toner is overflowed in the hopper, and the container is repetitively degassed by a degassing rod inserted in the flexible container to fill the toner in the container. However, the present invention enables a filling a toner without a hopper in a flexible container with little volumetric allowance.

A flexible container generally has less allowance in the internal volume of the container compared to the filling toner.

The above-mentioned filling step is not mandatory when the container has some allowance. The toner is discharged with the filling nozzle near the top of the container, or with the filling nozzle near the bottom of the container the filling is completed by pulling up the filling nozzle with a certain weight without degassing.

In the present invention, to resolve the above problems, the toner is discharged, as shown in FIG. 8, by inserting a filling nozzle which comprises the degassing mechanism at the periphery of the nozzle in the inside of the flexible container without touching.

In addition, degassing is performed when a certain amount, i.e. an amount with which the toner does not overflow from the container, of the toner is discharged. The degassing operation takes place while the toner discharge is suspended or continued. As a result, the attaching and removing operations of the hopper which was necessary in the conventional method are no longer required. Therefore, the operational efficiency is increased by approximately 20% compared to the conventional equivalents.

EXAMPLES

Hereinafter, the present invention is illustrated in more detail with a toner filling operation described below, but this is not to be construed as limiting the present invention.

Figure 5:
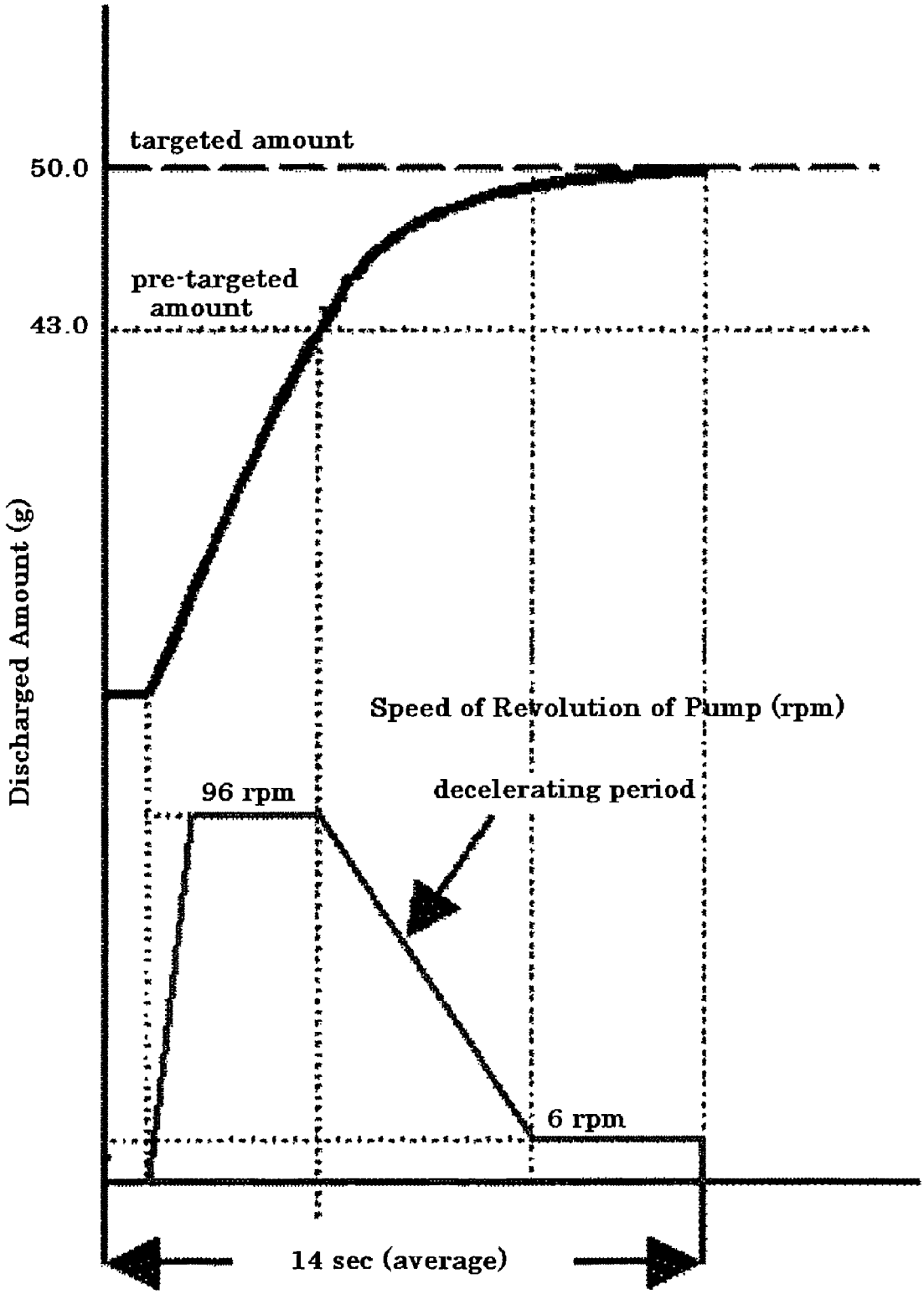
FIG. 5 is a diagram briefly describing the filling amount control.

A toner filling apparatus comprising a toner transferring apparatus shown in FIG. 4 was used. The toner transferring apparatus of FIG. 4 had a scale of a powder toner container and a motor controlled by a controller. FIG. 5 shows the changes in the controlled speed of rotation of the pump and the discharged amount.

(1) A fluidized toner was discharged in a filling container with a bellows pump which had been developed specifically for this apparatus.

Figure 6:
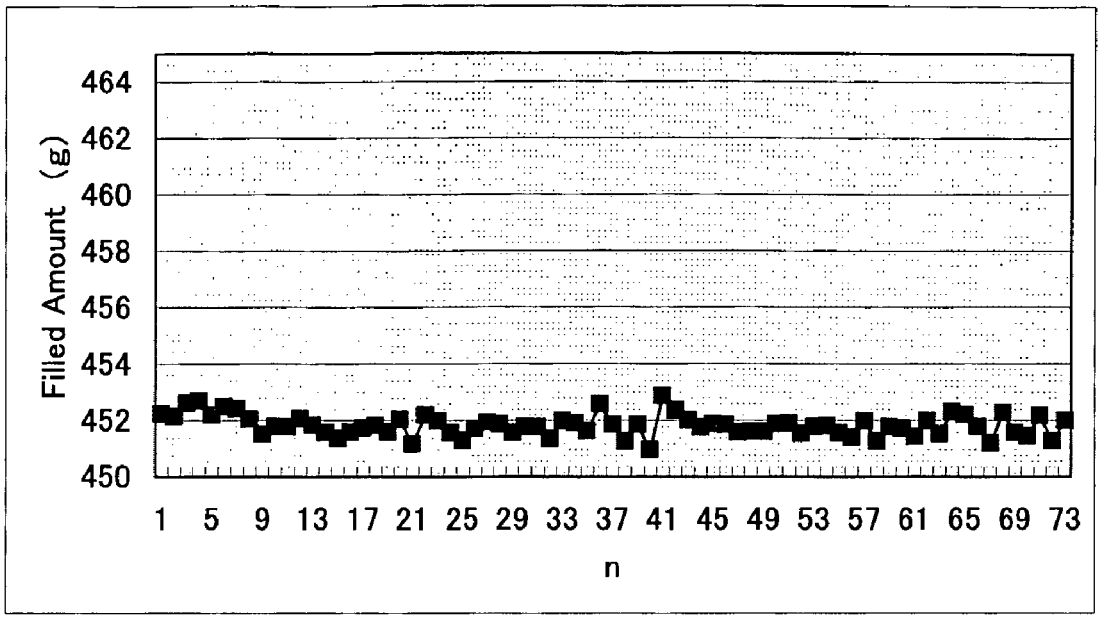
FIG. 6 is a graph showing the result of the filling amount control

(2) The discharged amount was measured to control the speed of rotation and the timing of the suspension, and the container was filled with a preset weight of the toner. In the present example, the targeted filling amount was 451.0 g, and the results of 73 consecutive filling operations are shown in FIG. 6. The ordinate axis of the graph in FIG. 6 indicates the filling amount, and the abscissa axis of the graph in FIG. 6 indicates the filling duration.

The toner employed was IPSiO Magenta 8000, manufactured by Ricoh Company, Ltd., with a bulk density of 0.47 g/cm$^3$.

Figure 7:
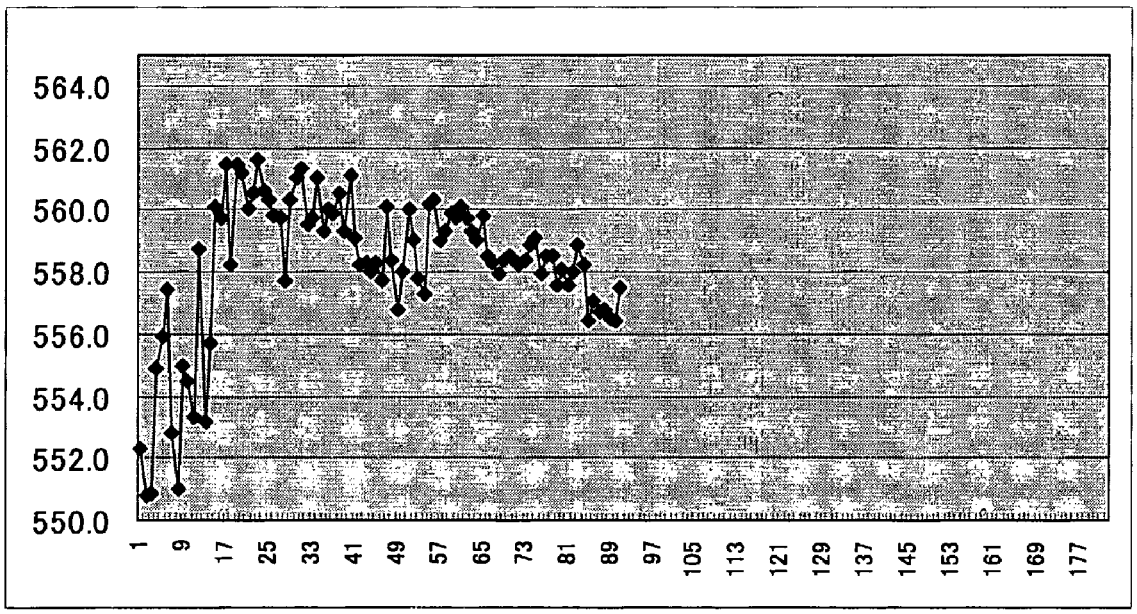
FIG. 7 shows the variation in the filling amount of a conventional filling apparatus with fluid pressurization.

As a comparative example, the results of the filling operation with a conventional toner filling apparatus by means of pressurization, described in JP-B No. 3549053, are shown in FIG. 7. The targeted filling amount was 550.0 g. When the filling amount was controlled by means of pressurizing filling method, the transferring pressure was reduced with the actual filling amount was near the preset amount, and the above-mentioned 'plugs' were formed in the filling nozzle with the filled amount equal to the preset value to complete the filling operation. In order to form the 'plugs' without completely reducing the transferring pressure to zero for completing the filling operation within a certain period of time, the actual filling amount was overshot by a large margin compared to the preset value. This overshooting is a loss to manufacturers.

The results in FIGS. 6 and 7 imply that the toner filling apparatus of the present invention in FIG. 6 may significantly improve the overshooting; that is, the actual filling amount is larger than the preset filling amount compared to the conventional toner filling apparatus in FIG. 7.

INDUSTRIAL APPLICABILITY

The powder toner transferring method and the powder toner transferring apparatus of the present invention are capable of transferring a powder toner without stressing the toner as well as transferring without pressurization or with minimum pressurization. No clogging of the powder toner occurs, and a portable transporting means, which is lightweight and compact, and operate intermittent suction, is used.

An on-demand use is possible since all the types of power supply voltage may be used. Therefore, they are favorably used for a filling method and a filling apparatus of a powder toner for electrophotograph.

The invention claimed is:

1. A powder toner transferring method, comprising:

fluidizing a powder toner in a powder toner repository with a gas supplied from an air supply unit, sucking the fluidized toner with a suction unit, and transferring the powder toner by discharging the powder toner in a powder toner filling container, wherein the sucking the fluidized toner by the suction unit is performed with a reciprocating-motion pump, an expansion and contraction part of which is located at a higher position than an inlet valve and an outlet valve of the suction unit.

2. The powder toner transferring method according to claim 1, wherein the gas supplied by the air supply unit to a sealable and pressurized or non-pressurized powder toner repository is regulated and introduced to a powder toner fluidization unit in the powder toner repository so that the powder toner is fluidized in the powder toner repository; the powder toner repository is sucked through a suction inlet of the suction unit so that the fluidized powder toner is delivered; and after the pulsating flow is flattened or promoted for flat flow by a pulsating-flow buffering unit located downstream the suction unit, the powder toner is discharged in the powder toner filling container.

3. The powder toner transferring method according to claim 1, wherein the reciprocating-motion pump is a bellows pump.

4. The powder toner transferring method according to claim 1, wherein an outlet of the reciprocating-motion pump is located below a suction inlet of the pump.

5. The powder toner transferring method according to claim 1, wherein the suction unit sucks the powder toner by reducing a pressure.

6. The powder toner transferring method according to claim 1, wherein the powder toner repository is under pressure of 4 kPa or less.

7. The powder toner transferring method according to claim 1, wherein a transferred amount of the powder toner is adjusted by controlling a cycle of suction.

8. The powder toner transferring method according to claim 4, wherein a pulsating flow buffer is installed in the vicinity of the outlet of the reciprocating-motion pump.

9. The powder toner transferring method according to claim 1, wherein the air supply unit includes a gas generation unit, and a power source of 24 V to 220 V is used for the air supply from the gas generation unit.

10. The powder toner transferring method according to claim 9, wherein the gas generation unit is a compressor.

11. The powder toner transferring method according to claim 1, wherein the air supply unit and the suction unit use any one of solar-power generation and wind-power generation.

12. The powder toner transferring method according to claim 1, wherein the air supply unit includes a high-pressure gas cylinder.

13. A powder toner transferring apparatus, comprising:

a sealable, pressurized or non-pressurized powder toner repository;

a gas supply unit which supplies a regulated gas to the powder toner repository;

a powder toner fluidization unit which is located in the powder toner repository and fluidizes the powder toner in the powder toner repository by letting out a distributed gas;

an intermittent suction unit which intermittently discharges the fluidized powder toner which is in the powder toner repository by intermittently sucking the powder toner repository with a reciprocating-motion pump, an expansion and contraction part of which is located at a higher position than an inlet valve and an outlet valve of the intermittent suction unit; and a pulsating flow buffering unit located at the downstream of the intermittent suction unit.

14. The powder toner transferring apparatus according to claim 13, wherein the gas supply unit, the intermittent suction unit, and the pulsating flow buffer unit are detachably mounted in a case; the case is portable and includes a handle, and the case includes on its surface any one of a power supply connection unit and a switch unit to a power source of 24 V to 220 V for the gas supply unit and powder suction unit.

15. The powder toner transferring apparatus according to claim 14, wherein the case further includes a pulsating flow buffering unit housing space to house the pulsating flow buffering unit, a tubular member housing space to house a bundle of various tubular members, and a power code housing space.

16. The powder toner transferring apparatus according to claim 14, wherein at least a portion of the case is transparent such that a part of the inside of the repository is visually observable, at least a portion of the powder toner repository is transparent such that the existence of the powder toner inside the repository is visually observable, and the transparent portion of the case and the transparent portion of the powder toner repository are at least partially overlapping.

17. The powder toner transferring apparatus according to claim 14, wherein the case includes an openable and closable lid which may be opened while the powder toner transferring apparatus is in operation.

18. The powder toner transferring apparatus according to claim 13, wherein the powder toner includes an external additive, the volumetric average particle diameter of the toner is 2.5 μm to 15 μm, the absolute specific gravity of the toner is 1.02 to 1.45, and the bulk density of the toner is 0.20 g/cm$^3$ to 0.90 g/cm$^3$.

19. The powder toner transferring apparatus according to claim 13, wherein the powder toner is volumetrically increased in the powder toner repository by a factor of 1.2 to 15 by a gas.

20. A powder toner filling apparatus, comprising:

a powder toner transferring apparatus which includes:

a sealable, pressurized or non-pressurized powder toner repository;

a gas supply unit which supplies a regulated gas to the powder toner repository;

a powder toner fluidization unit which is located in the powder toner repository and fluidizes the powder toner in the powder toner repository by letting out a distributed gas;

an intermittent suction unit which intermittently discharges the fluidized powder toner which is in the powder toner repository by intermittently sucking the powder toner repository with a reciprocating-motion pump, an expansion and contraction part of which is located at a higher position than an inlet valve and an outlet valve of the intermittent suction unit; and a pulsating flow buffering unit located at the downstream of the intermittent suction unit.

21. The powder toner filling apparatus according to claim 20, wherein the powder toner filling apparatus comprises multiple intermittent suction units.

22. The powder toner filling apparatus according to claim 20, wherein the powder toner filling apparatus interlocks a scale, which weighs a discharged toner, with the number of revolutions of the motor which controls the pump.

23. The powder toner filling apparatus according to claim 20, which further comprises:

a toner discharge pipe installed over a toner filling container without a direct contact with the container; and a degassing tube, which is a detachable hollow tube with both ends sealed in the toner filling container with its lower end composed of a porous material and the other end connected to a vacuum system, which degases the air inside the toner filling container through the porous portion, wherein the fluidized toner is discharged by the drive of a bellows pump; at the same time as the discharge or after discharging a predefined amount, the toner filling container is deaerated through a ventilation tube, and a predefined mass of powder toner is filled in the toner filling container of a given volume.

24. The powder toner filling apparatus according to claim 23, wherein the toner discharge pipe is inserted close to but not touching the bottom of the powder toner filling container; a predefined mass of powder toner is discharged at once or more than once with a degassing operation in between with the toner discharge pipe immersed in the powder toner; after a certain mass is reached, the toner discharge pipe is pulled up close to the inlet of the toner filling container; and the discharge is continued until a value of the weight indicator reaches a set value while the toner discharge pipe is not in contact with the toner powder and a powder toner cartridge.

25. The powder toner filling apparatus according to claim 23, wherein a degassing unit concentric with the toner discharge pipe is located outside the toner discharge pipe; a toner filling nozzle including the degassing unit whose toner discharge tube has a lower end formed by a porous material, the toner filling nozzle is inserted close to but not touching the bottom of the powder toner filling container, and a predefined mass of toner is discharged; while discharging or after alternatively discharging and degassing, the filling nozzle is pulled up close to the inlet of the toner filling container for additional discharge; having signaled that the filling is completed, the degassing unit is depressurized to suck the powder toner in the toner discharge pipe to the inner wall of the degassing unit and form plugs, and the filling terminates.

26. The powder toner filling apparatus according to claim 25, wherein reverse air pressure and air flowrate are independently controlled to prevent clogging the degassing unit and a plug formation unit.

27. The powder toner filling apparatus according to claim 20, wherein a pressure sensor is installed perpendicularly at the discharge side of a bellows pump which sucks and discharges the fluidized toner, or at an assembly part of the bellows discharge tubes when multiple bellows are included in one toner transportation mechanism; the toner discharge pressure is continuously measured; the filling is interrupted at a pressure greater than a certain level, and a caution or warning is issued.

28. A powder toner filling method which comprises:

a powder toner transferring method which includes:

fluidizing a powder toner in a powder toner repository with a gas supplied from an air supply unit, sucking the fluidized toner with a suction unit, and transferring the powder toner by discharging the powder toner in a powder toner filling container, wherein the sucking the fluidized toner by the suction unit is performed with a reciprocating-motion pump, an expansion and contraction part of which is located at a higher position than an inlet valve and an outlet valve of the suction unit.

29. The powder toner filling method according to claim 28, wherein the method uses a powder toner filling apparatus which includes a toner discharge pipe installed over a toner filling container without a direct contact with the filling container; and a degassing tube, which is a detachable hollow tube with both ends sealed in the toner filling container with its lower end composed of a porous material and the other end connected to a vacuum system, which degases the air inside the toner filling container through the porous portion, wherein the fluidized toner is discharged by the drive of a bellows pump; at the same time as the discharge or after discharging a predefined amount, the toner filling container is deaerated through a ventilation tube, and a predefined mass of powder toner is filled in the toner filling container of a given volume.

30. The powder toner filling method according to claim 28, wherein the method uses a powder toner filling apparatus including a toner discharge pipe and a powder toner filling container, wherein the toner discharge pipe is inserted close to but not touching the bottom of the powder toner filling container; a predefined mass of powder toner is discharged at once or more than once with degassing operation in between with the toner discharge pipe immersed in the powder toner; after a certain mass is reached, the toner discharge pipe is pulled up close to the inlet of the toner filling container; and the discharge is continued until a value of the weight indicator reaches a set value while the toner discharge pipe is not in contact with the toner powder and a powder toner cartridge.

31. The powder toner filling method according to claim 29, wherein a degassing unit concentric with the toner discharge pipe is located outside the toner discharge pipe; using a toner filling nozzle including the degassing unit whose toner discharge tube has a lower end formed by a porous material, the toner filling nozzle is inserted close to but not touching the bottom of the powder toner filling container, and a predefined mass of toner is discharged; while discharging or after alternatively discharging and degassing, the filling nozzle is pulled up close to the inlet of the toner filling container for additional discharge; having signaled that the filling is completed, the degassing unit is depressurized to suck the powder toner in the toner discharge pipe to the inner wall of the degassing unit and form plugs, and the filling terminates.

32. The powder toner filling method according to claim 31, wherein reverse air pressure and air flowrate are independently controlled to prevent clogging the degassing unit and a plug formation unit.

33. The powder toner filling method according to claim 28, wherein a pressure sensor is installed perpendicularly at the discharge side of a bellows pump which sucks and discharges the fluidized toner, or at an assembly part of the bellows discharge tubes when multiple bellows are included in one toner transportation mechanism; the toner discharge pressure is continuously measured; the filling is asserted at a pressure greater than a certain level, and a caution or warning is issued.

* * * * *